US009902479B1

(12) United States Patent
Sako et al.

(10) Patent No.: US 9,902,479 B1
(45) Date of Patent: Feb. 27, 2018

(54) BOAT SHIFT CONTROL DEVICE AND BOAT SHIFT CONTROL METHOD

(71) Applicant: Mitsubishi Electric Corporation, Tokyo (JP)

(72) Inventors: Hitoshi Sako, Hyogo (JP); Yohei Yamaguchi, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/484,600

(22) Filed: Apr. 11, 2017

(30) Foreign Application Priority Data

Nov. 2, 2016 (JP) ..... 2016-214948

(51) Int. Cl.

| | |
|---|---|
| ***B60L 3/00*** | (2006.01) |
| ***B60L 15/00*** | (2006.01) |
| ***G05D 1/00*** | (2006.01) |
| ***B63H 21/21*** | (2006.01) |
| ***B63H 20/00*** | (2006.01) |
| ***B63H 21/14*** | (2006.01) |
| *B63J 99/00* | (2009.01) |

(52) U.S. Cl.
CPC ..... *B63H 21/213* (2013.01); *B63H 20/00* (2013.01); *B63H 21/14* (2013.01); *B63B 2758/00* (2013.01); *B63H 2020/003* (2013.01); *B63H 2021/216* (2013.01); *B63J 2099/006* (2013.01)

(58) Field of Classification Search
CPC ... B63H 21/213; B63H 21/26; B63J 2099/006
USPC ..... 701/21
See application file for complete search history.

(56) References Cited

U.S. PATENT DOCUMENTS

2010/0248560 A1* 9/2010 Ito ..... B63H 21/22 440/1
2016/0347433 A1* 12/2016 Koyano ..... B63H 11/107

FOREIGN PATENT DOCUMENTS

JP 3833616 B2 10/2006

* cited by examiner

*Primary Examiner* — Isaac G Smith
(74) *Attorney, Agent, or Firm* — Sughrue Mion, PLLC; Richard C. Turner

(57) ABSTRACT

Provided are an LP sensor that detects any one shift state from among forward, reverse and neutral, on the basis of an operation state of respective throttle levers corresponding to a plurality of engines, and a controller that controls the plurality of engines. The controller detects a simulated boat speed on the basis of the respective rotational speeds of the plurality of engines. When from a state in which the boat is operated by some engines from among the plurality of engines an attempt is made to operate the remaining engines being in a neutral shift state, the controller sets a shift-in prohibition flag of a corresponding engine, and prohibits shift-in control of the remaining engine, in a case where the simulated boat speed is higher than a first determination value.

9 Claims, 9 Drawing Sheets

BOAT SHIFT CONTROL DEVICE AND BOAT SHIFT CONTROL METHOD

BACKGROUND OF THE INVENTION

1. Field of the Invention

The present invention relates to a boat shift control device and boat shift control method, which are used to control shifting of an internal combustion engine in a situation where a plurality of internal combustion engines are mounted on a boat and only a specific engine, other than the former engine, thereamong is being used to operate the boat.

2. Description of the Related Art

Known technologies of engine shift control during a sudden shifting operation involve performing shift connection once revolutions have dropped sufficiently during propeller driving, to reduce the load that is exerted on the engine and prevent problems such as engine stalls.

In such technologies there is used for instance a conjectured rotational speed resulting from simulating the speed of the hull, for the purpose of prohibiting shift-in to reverse within a certain boat speed range and thus reducing engine loading and preventing engine stalling. Proposed such technologies include the one described in Japanese Patent No. 3833616.

SUMMARY OF INVENTION

Conventional technologies have however the following problems.

The conventional shift-in prevention control scheme described above involves setting a shift-in prohibition on the basis of a parameter obtained by simulating boat speed, and performing control of permitting shift-in after the boat speed has dropped to a predetermined value.

In the case of boats, however, a situation has become common in recent years where not just one engine but a plurality of engines is set in one boat.

For instance, there is conceivably provided a plurality of engines, i.e. two or three engines, the boat being operated with a specific engine alone. In such a case, once the boat speed has become equal to or higher than a given speed, a user may then operate the shifts and throttles in order to operate the remaining engines.

The load acting on the engines increases when the shift-in operation is carried out within a certain boat speed range. Moreover, the load on the gear boxes may in increase, which in the worst case may lead to gear breakdown that renders any subsequent operation impossible.

In view of such usage environment of a boat, it is an object of the present invention to achieve a boat shift control device and a boat shift control method that allow reliably protecting engines and gear boxes even in a case where there is set a plurality of engines and the boat is operated using a specific engine alone.

A boat shift control device according to the present invention is a boat shift control device that controls shift-in and shift-out of a plurality of engines mounted on a boat, the boat shift control device having: a rotational speed detector that detects the rotational speed of each of the plurality of engines; an LP sensor that detects any one shift state from among forward, reverse and neutral, on the basis of an operation state of respective throttle levers corresponding to the plurality of engines; and a controller that controls the plurality of engines; wherein the controller detects a simulated boat speed on the basis of the respective rotational speeds of the plurality of engines; and in a case where the simulated boat speed is higher than a pre-set first determination value when from a state in which the boat is operated by a part of the plurality of engines an attempt is made to operate the remaining engine being in a neutral shift state, the controller sets a shift-in prohibition flag of a corresponding engine, and prohibits shift-in control of the remaining engine.

A boat shift control method according to the present invention is executed by a controller that controls shift-in and shift-out of a plurality of engines mounted on a boat, the method having: a first step of calculating a simulated boat speed of the boat on the basis of respective rotational speeds of the plurality of engines as detected by a rotational speed detector; a second step of detecting, on the basis of a detection result by an LP sensor that detects any one shift state from among forward, reverse and neutral on the basis of an operation state of respective throttle levers corresponding to the plurality of engines, a shift-in operation state where, from a state in which the boat is operated by a part of the plurality of engines, an attempt is made to operate the remaining engine being in a neutral shift state; and a third step of setting a shift-in prohibition flag of a corresponding engine, and prohibiting shift-in control of the remaining engine if, upon detection of the shift-in operation state according to the second step, the simulated boat speed calculated in the first step is higher than a pre-set first determination value.

According to the present invention, during operation of only a specific engine among a plurality of installed engines, shift-in is prohibited when detecting that the boat has a certain speed at a timing at which a remaining engine is to be operated. As a result it becomes possible to achieve a boat shift control device and a boat shift control method that allow reliably protecting engines and gear boxes also in a case where there is set a plurality of engines and the boat is operated using a specific engine alone.

DESCRIPTION OF THE PREFERRED EMBODIMENTS

Preferred embodiments of the boat shift control device and the boat shift control method of the present invention will be explained next with reference to accompanying drawings.

Embodiment 1

Figure 1:
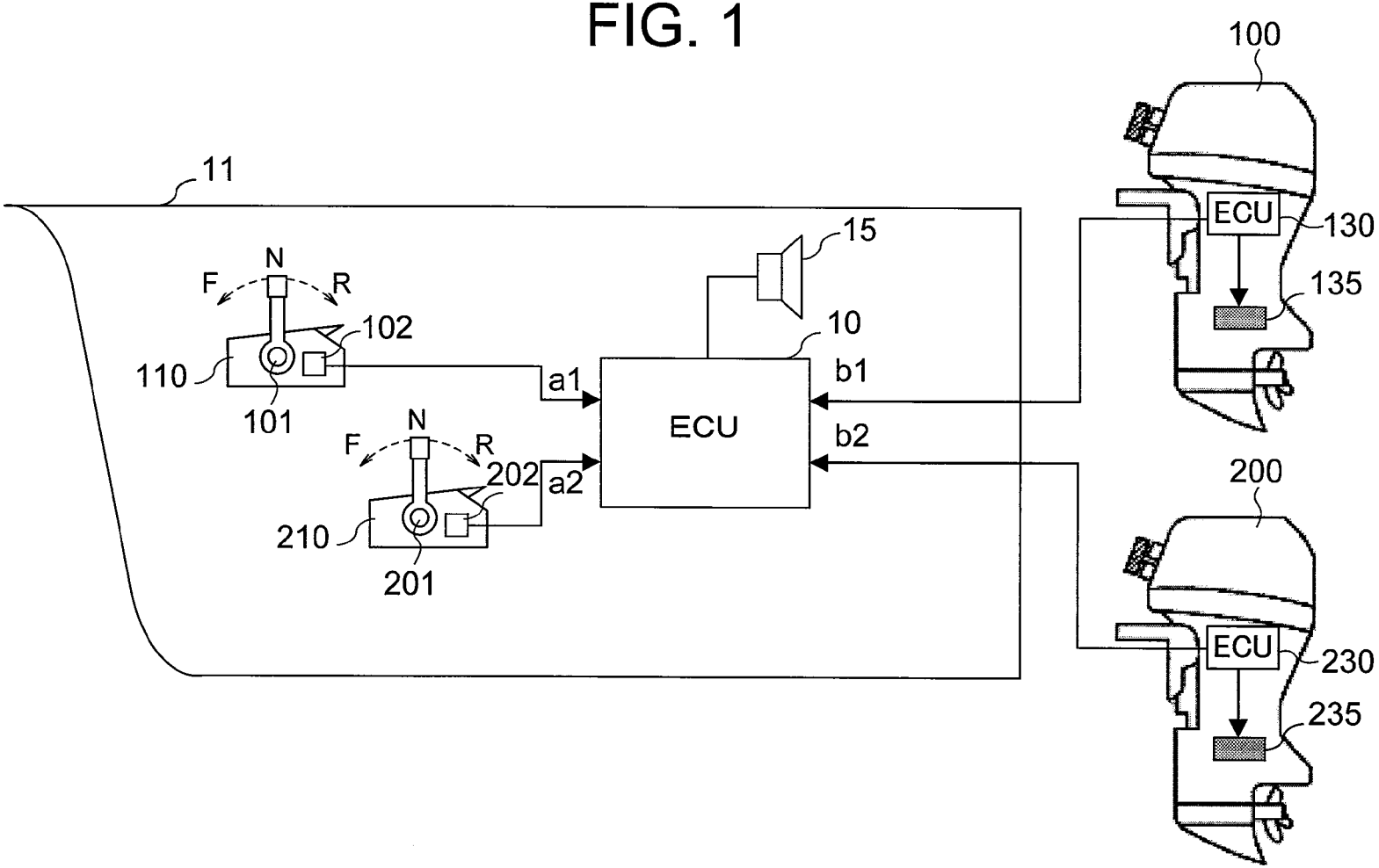
FIG. 1 is an overall configuration diagram of a boat shift control device according to Embodiment 1 of the present invention, in an instance where the boat shift control device is utilized in a marine internal combustion engine.

FIG. 1 is an overall configuration diagram of a boat shift control device according to Embodiment 1 of the present invention, in an instance where the boat shift control device is utilized in a marine internal combustion engine. Two outboard motors 100, 200 having each an internal combustion engine (hereafter, "engine"), a propeller and so forth integrated thereinto, are provided with respective electronic control units (ECUs) 130, 230 as control means. The outboard motors 100, 200 are mounted on the stern of a boat 11. FIG. 1 depicts a two-motor configuration that will be explained in detail below as a specific example.

Throttle levers 101, 201 are disposed in boat maneuver remote controls 110, 210. The throttle levers 101, 201 are provided with LP sensors 102, 202 (lever position sensors) that detect a lever position.

Lever position signals detected by the LP sensors 102, 202 are outputted to the ECU 10 that performs shift control, via signal lines a1, a2. On the basis of the received respective lever position signal, the ECU 10 detects a request amount of throttle valve (hereafter referred to as requested throttle opening degree) and a request amount of forward/neutral/reverse (hereafter referred to as requested shift position).

On the basis of the lever position and the engine state, the ECU 10 determines an amount of opening of the respective throttle valve from fully closed to fully open (hereafter referred to as target throttle opening degree) and a shift position (hereafter referred to as target shift position).

A buzzer 15 is connected to the ECU 10. If the ECU 10 determines that an anomaly or the like has occurred, the ECU 10 outputs an audible alarm via the buzzer 15.

The ECU 10 instructs command values of the target throttle opening degree (from full closed to full open) and the target shift position (F/N/R) to the ECUs 130, 230 in the two outboard motors 100, 200, via signal lines b1, b2.

Having received the command values, the ECUs 130, 230 inside the outboard motors 100, 200 output an amount of opening (intake air amount) of the respective throttle valves via a link mechanism. The ECUs 130, 230 output a shift position (forward/neutral/reverse) via a shift link mechanism (not shown) and the gear mechanisms 135, 235.

The ECUs 130, 230 transmit to the ECU 10 respective actual engine states including engine rotational speed, amount of throttle valve opening (actual throttle opening degree) and shift position (actual shift position).

The details of the shift control process executed by the ECU 10 will be explained next on the basis of the flowcharts illustrated in FIG. 2 to FIG. 7.

Figure 2:
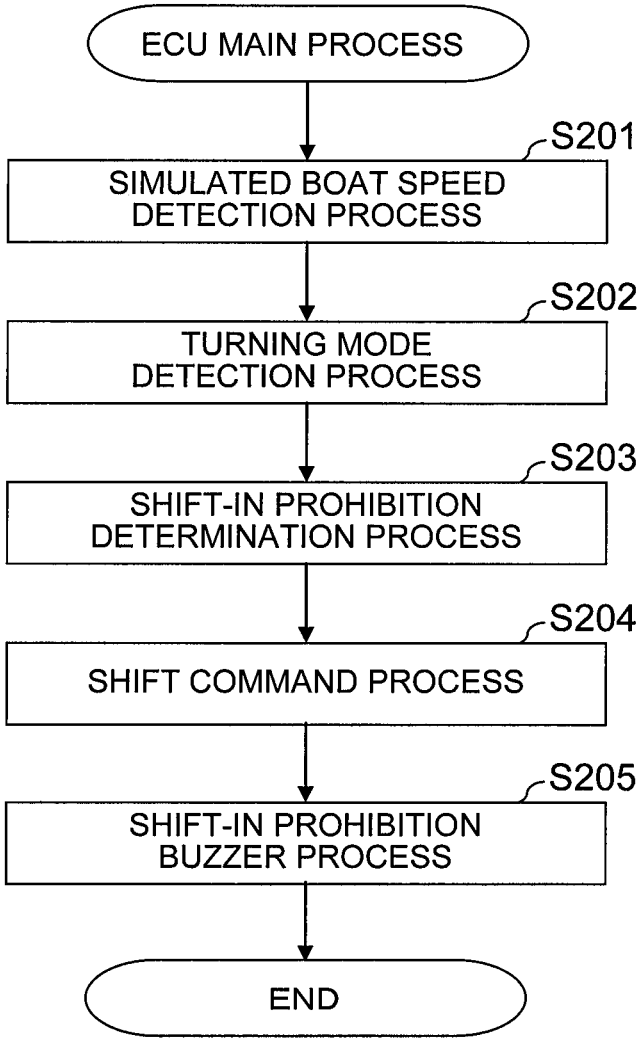
FIG. 2 is a flowchart illustrating a shift control process that is executed, as a main control process, by an ECU 10 in Embodiment 1 of the present invention.

FIG. 2 is a flowchart illustrating the shift control process that is executed, as a main control process, by the ECU 10 in Embodiment 1 of the present invention. The main control process is executed every 5 ms.

In step S201, firstly, the ECU 10 executes a simulated boat speed detection process. The details of the simulated boat speed detection process will be explained further on with reference to FIG. 3.

In step S202 next, the ECU 10 executes a turning mode detection process. The details of the turning mode detection process will be explained further on with reference to FIG. 4A to FIG. 4C.

In step S203 next, the ECU 10 executes a shift-in prohibition determination process, and performs prohibition determination relating to shifting from N to F and from N to R. The details of the shift-in prohibition determination process will be explained further on with reference to FIG. 5.

In step S204 next, the ECU 10 executes a shift command process, and instructs the shift position (F/N/R). The details of the shift command process will be explained further on with reference to FIG. 6.

In step S205, lastly, the ECU 10 executes a shift-in prohibition buzzer process, and outputs a warning via a warning buzzer. The details of the shift-in prohibition buzzer process will be explained further on with reference to FIG. 7.

Figure 3:
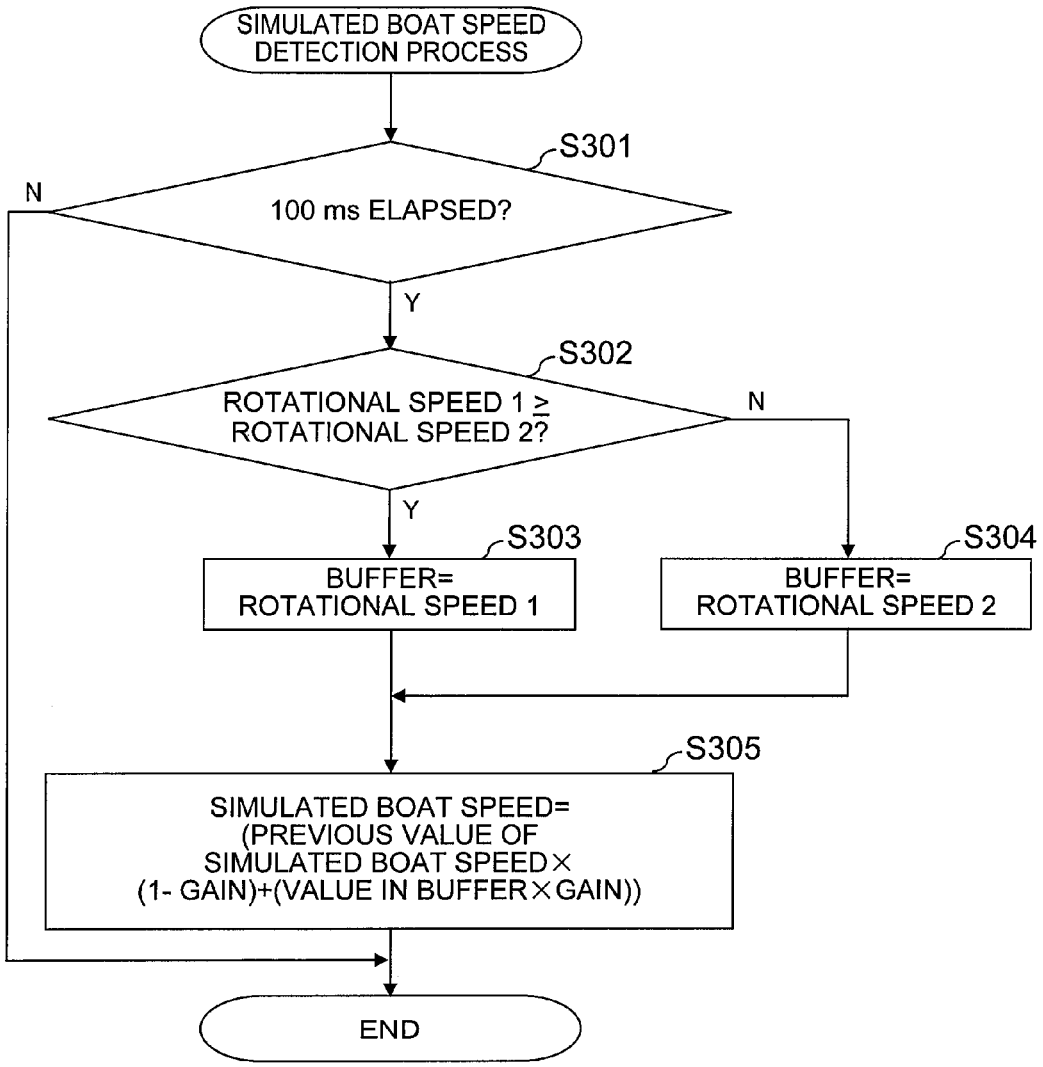
FIG. 3 is a flowchart relating to a simulated boat speed detection process in Embodiment 1 of the present invention.

FIG. 3 is a flowchart relating to the simulated boat speed detection process in Embodiment 1 of the present invention. In step S301, firstly, the ECU 10 determines whether a detection period has elapsed or not. In the present Embodiment 1 an instance will be explained where the detection period is set to 100 ms. The detection period may however be set arbitrarily.

If the ECU 10 determines that the detection period has elapsed, the ECU 10 executes the series of processes from step S302 onwards. If on the other hand the ECU 10 determines that the detection period has not elapsed, the ECU 10 terminates the series of processes.

If having proceeded to step S302, the ECU 10 compares the engine rotational speed of the outboard motor 100 (rotational speed 1) and the engine rotational speed of the outboard motor 200 (rotational speed 2). The ECU 10 detects the rotational speed 1 and the rotational speed 2 on the basis of rotational speed detectors not shown.

If the rotational speed 1 is equal to or greater than the rotational speed 2, the ECU 10 executes step S303. If on the other hand the rotational speed 1 is lower than the rotational speed 2, the ECU 10 executes step S304.

If having proceeded to step S303, the ECU 10 sets the rotational speed 1 in a calculation buffer, and thereafter executes step S305.

If having proceeded to step S304, the ECU 10 sets the rotational speed 2 in the calculation buffer, and thereafter executes step S305.

In step S305, lastly, the ECU 10 performs a filtering process of a previous simulated boat speed and the current engine rotational speed set in the buffer, and terminates the series of processes pertaining to simulated boat speed detection. Specifically, the ECU 10 executes a filtering process according to the expression below. The gain can be set between 0 and 1.

$$\text{Simulated boat speed} = \text{previous value of simulated boat speed} \times (1-\text{gain}) + (\text{value in buffer} \times \text{gain})$$

Figure 4A:
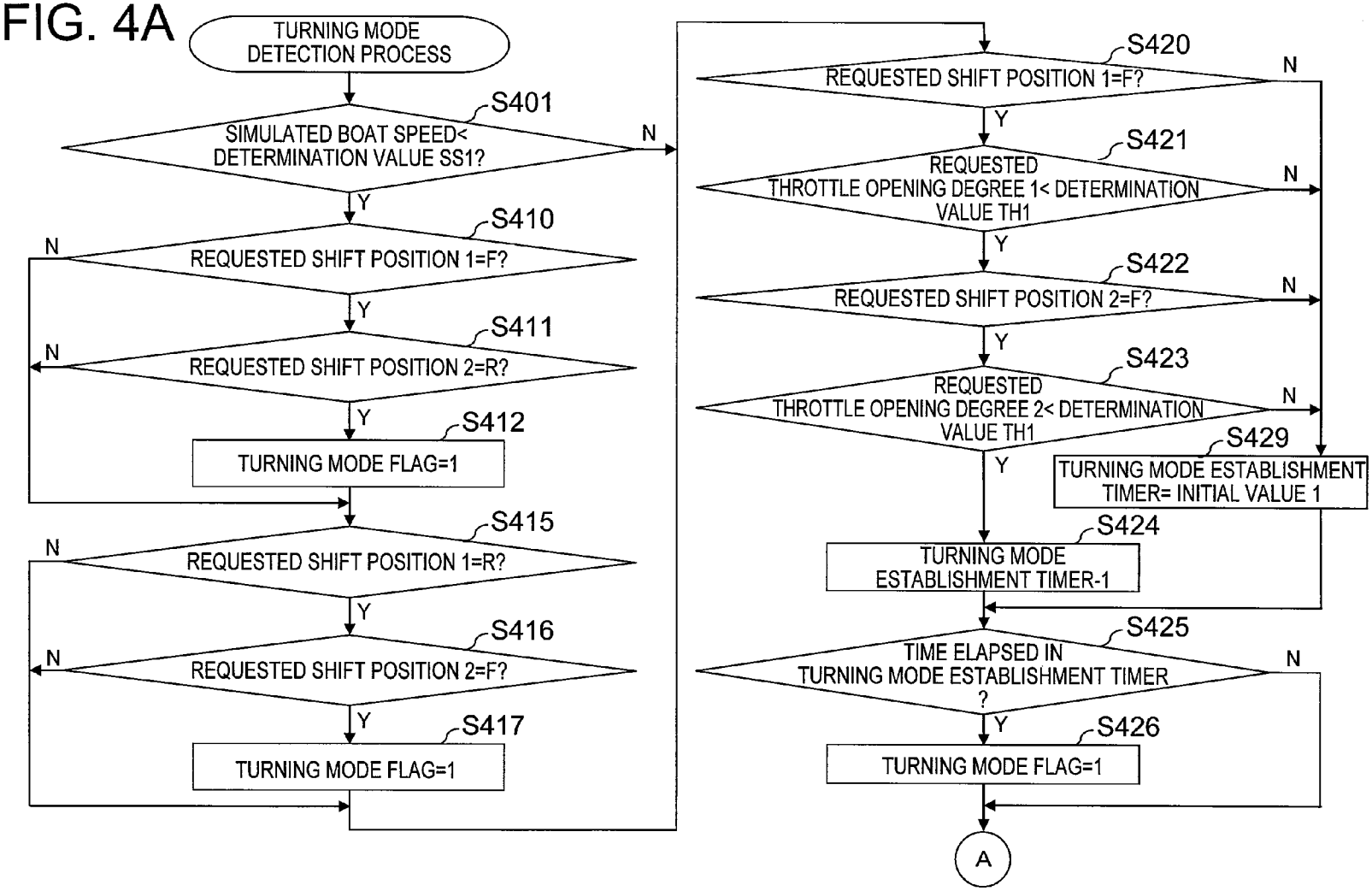
FIG. 4A is a flowchart of a turning mode detection process of Embodiment 1 of the present invention.
Figure 4B:
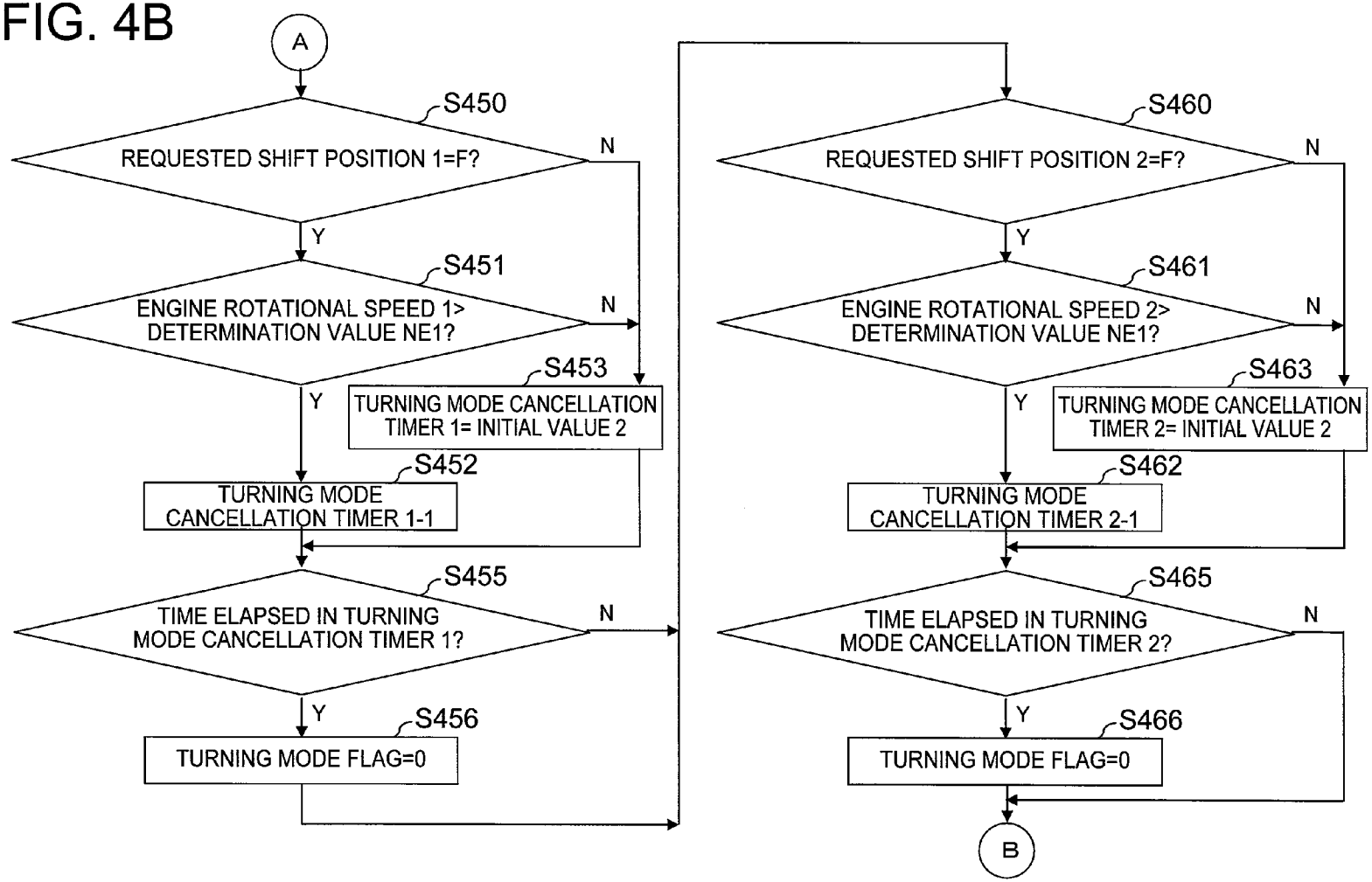
FIG. 4B is a flowchart of a turning mode detection process of Embodiment 1 of the present invention.
Figure 4C:
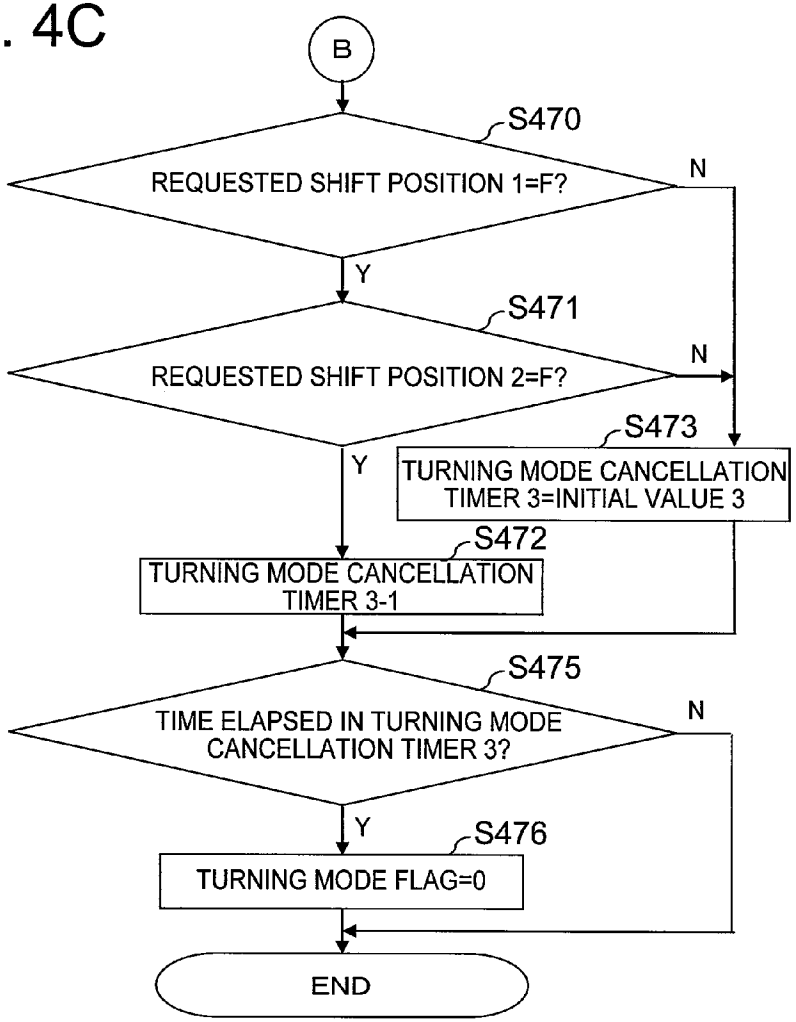
FIG. 4C is a flowchart of a turning mode detection process of Embodiment 1 of the present invention.

FIG. 4A to FIG. 4C are flowcharts of a turning mode detection process of Embodiment 1 of the present invention. Through this process the ECU 10 determines the establishment and cancellation of a turning mode. In step S401, firstly, the ECU 10 determines whether the simulated boat speed is lower than a determination value SS1 or not. If the simulated boat speed is lower than the determination value SS1, the ECU 10 executes step S410, while if the simulated boat speed is equal to or higher than the determination value SS1, the ECU 10 executes step S420.

In step S410, the ECU 10 determines whether a requested shift position 1 has been set to forward (F) or not through operation of the throttle lever 101 of the boat maneuver remote control 110 by the boat operator. If the requested shift position 1 is set to F, the ECU 10 executes step S411. If on the other hand the requested shift position 1 is not F, the ECU 10 executes step S415.

In step S411, the ECU 10 determines whether a requested shift position 2 has been set to reverse (R) or not through operation of the throttle lever 201 of the boat maneuver remote control 210 by the boat operator. If the requested shift position 2 is set to R, the ECU 10 executes step S412. If on the other hand the requested shift position 2 is not R, the ECU 10 executes step S415.

In step S412, the ECU 10 determines that a turning operation is in progress, sets the turning mode flag to 1, and executes step S415.

In step S415, the ECU 10 determines whether or not the requested shift position 1 is set to R. If the requested shift position 1 is set to R, the ECU 10 executes step S416. If on the other hand the requested shift position 1 is not R, the ECU 10 executes step S420.

In step S416, the ECU 10 determines whether or not the requested shift position 2 is set to F. If the requested shift position 2 is set to F, the ECU 10 executes step S417. If on the other hand the requested shift position 2 is not F, the ECU 10 executes step S420.

In step S417, the ECU 10 determines that a turning operation is in progress, sets the turning mode flag to 1, and executes step S420.

In step S420, the ECU 10 determines whether or not the requested shift position 1 is set to F. If the requested shift position 1 is set to F, the ECU 10 executes step S421. If on the other hand the requested shift position 1 is not F, the ECU 10 executes step S429.

In step S421, the ECU 10 determines whether or not a requested throttle opening degree 1 set through operation of the throttle lever 101 of the boat maneuver remote control 110 by the boat operator is lower than a determination value TH1. If the requested throttle opening degree 1 is lower than the determination value TH1, the ECU 10 executes step S422. If on the other hand the requested throttle opening degree 1 is equal to or higher than the determination value TH1, the ECU 10 executes step S429.

In step S422, the ECU 10 determines whether or not the requested shift position 2 is set to F. If the requested shift position 2 is set to F, the ECU 10 executes step S423. If on the other hand the requested shift position 2 is not F, the ECU 10 executes step S429.

In step S423, the ECU 10 determines whether or not a requested throttle opening degree 2 set through operation of the throttle lever 201 of the boat maneuver remote control 210 by the boat operator is lower than the determination value TH1. If the requested throttle opening degree 2 is lower than the determination value TH1, the ECU 10 executes step S424. If on the other hand the requested throttle opening degree 2 is equal to or higher than the determination value TH1, the ECU 10 executes step S429.

If having proceeded to step S424, the ECU 10 determines that the turning mode establishment condition is satisfied, allows a turning mode establishment timer to implement countdown, and thereafter executes step S425.

If having proceeded to step S429, on the other hand, the ECU 10 sets an initial value 1 in the turning mode establishment timer, and executes step S425.

In step S425, the ECU 10 determines whether or not a set time has elapsed in the turning mode establishment timer. If the set time has elapsed in the turning mode establishment timer, the ECU 10 executes step S426. If on the other hand the set time has not elapsed in the turning mode establishment timer, the ECU 10 executes step S450.

If having proceeded to step S426, the ECU 10 sets the turning mode flag to 1, and executes step S450.

With reference to FIG. 4B, the ECU 10 determines next, in step S450, whether or not the requested shift position 1 is set to F. If the requested shift position 1 is set to F, the ECU 10 executes step S451. If on the other hand the requested shift position 1 is not F, the ECU 10 executes step S453.

In step S451, the ECU 10 determines whether or not an engine rotational speed 1 is higher than a determination value NE1. If the engine rotational speed 1 is higher than the determination value NE1, the ECU 10 executes step S452. If on the other hand the engine rotational speed 1 is equal to or lower than the determination value NE1, the ECU 10 executes step S453.

If having proceeded to step S452, the ECU 10 determines that a turning mode cancellation condition is satisfied, allows a turning mode cancellation timer 1 to implement countdown, and thereafter executes step S455.

If having proceeded on the other hand to step S453, the ECU 10 determines that the turning mode cancellation condition is not satisfied, sets an initial value 2 in the turning mode cancellation timer 1, and thereafter executes step S455.

In step S455, the ECU 10 determines whether or not a set time has elapsed in the turning mode cancellation timer 1. If the set time has elapsed in the turning mode cancellation timer 1, the ECU 10 executes step S456. If on the other hand the set time has not elapsed in the turning mode cancellation timer 1, the ECU 10 executes step S460.

If having proceeded to step S456, the ECU 10 determines that the turning mode cancellation condition is satisfied, clears the turning mode flag, and executes step S460.

In step S460, the ECU 10 determines whether or not the requested shift position 2 is set to F. If the requested shift position 2 is set to F, the ECU 10 executes step S461. If on the other hand the requested shift position 2 is not F, the ECU 10 executes step S463.

In step S461, the ECU 10 determines whether or not an engine rotational speed 2 is higher than the determination value NE1. If the engine rotational speed 2 is higher than the determination value NE1, the ECU 10 executes step S462. If on the other hand the engine rotational speed 2 is equal to or lower than the determination value NE1, the ECU 10 executes step S463.

If having proceeded to step S462, the ECU 10 determines that a turning mode cancellation condition is satisfied, allows a turning mode cancellation timer 2 to implement countdown, and thereafter executes step S465.

If having proceeded on the other hand to step S463, the ECU 10 determines that the turning mode cancellation condition is not satisfied, sets an initial value 2 in the turning mode cancellation timer 2, and executes step S465.

In step S465, the ECU 10 determines whether or not a set time has elapsed in the turning mode cancellation timer 2. If the set time has elapsed in the turning mode cancellation timer 2, the ECU 10 executes step S466. If on the other hand the set time has not elapsed in the turning mode cancellation timer 2, the ECU 10 executes step S470.

If having proceeded to step S466, the ECU 10 determines that the turning mode cancellation condition is satisfied, clears the turning mode flag, and executes step S470.

With reference to FIG. 4C, the ECU 10 determines next, in step S470, whether or not the requested shift position 1 is set to F. If the requested shift position 1 is set to F, the ECU 10 executes step S471. If on the other hand the requested shift position 1 is not F, the ECU 10 executes step S473.

In step S471, the ECU 10 determines whether or not the requested shift position 2 is set to F. If the requested shift position 2 is set to F, the ECU 10 executes step S472. If on the other hand the requested shift position 2 is not F, the ECU 10 executes step S473.

If having proceeded to step S472, the ECU 10 determines that a turning mode cancellation condition is satisfied, allows a turning mode cancellation timer 3 to implement countdown, and thereafter executes step S475.

If having proceeded on the other hand to step S473, the ECU 10 determines that the turning mode cancellation condition is not satisfied, sets an initial value 3 in the turning mode cancellation timer 3, and executes step S475.

In step S475, the ECU 10 determines whether or not a set time has elapsed in the turning mode cancellation timer 3. If the set time has elapsed in the turning mode cancellation timer 3, the ECU 10 executes step S476. If on the other hand the set time has not elapsed in the turning mode cancellation timer 3, the ECU 10 terminates the series of processes relating to turning mode detection.

If having proceeded to step S476, the ECU 10 determines that the turning mode cancellation condition is satisfied, clears the turning mode flag, and terminates the series of processes relating to turning mode detection.

Figure 5:
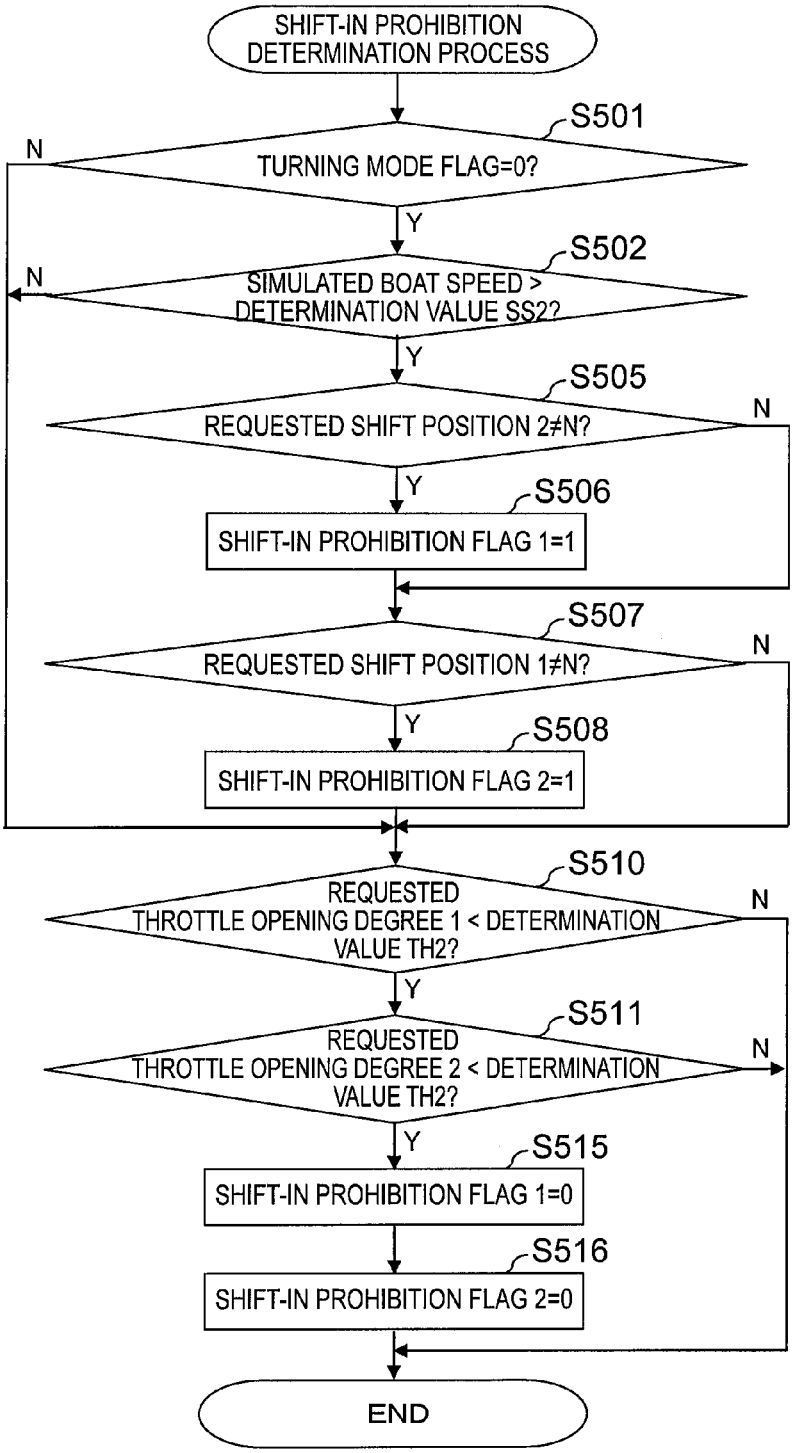
FIG. 5 is a flowchart of a shift-in prohibition determination process in Embodiment 1 of the present invention.

FIG. 5 is a flowchart of the shift-in prohibition determination process in Embodiment 1 of the present invention. In step S501, firstly, the ECU 10 determines whether the turning mode flag is reset or not. If the turning mode flag is reset, the ECU 10 executes step S502. If the turning mode flag is set, the ECU 10 executes step S510.

In step S502, the ECU 10 determines whether the simulated boat speed is higher than a determination value SS2 or not. If the simulated boat speed is higher than the determination value SS2, the ECU 10 executes step S505. If on the other hand the simulated boat speed is equal to or lower than the determination value SS2, the ECU 10 executes step S510.

In step S505, the ECU 10 determines whether or not the requested shift position 2 is set to other than N. If the requested shift position 2 is set to F or R other than N, the ECU 10 executes step S506. If on the other hand the requested shift position 2 is N, the ECU 10 executes step S507.

In the case of two or more motors there are set all the requested shift positions other than those for self-maneuver remote control.

If having proceeded to step S506, the ECU 10 determines that there is a shift-in command in a high boat speed state, sets to 1 a shift-in prohibition flag 1, and executes step S507.

In step S507, the ECU 10 determines whether or not the requested shift position 1 is set to other than N. If the requested shift position 1 is set to F or R other than N, the ECU 10 executes step S508. If on the other hand the requested shift position 1 is N, the ECU 10 executes step S510.

In the case of two or more motors there are set all the requested shift positions other than those for self-maneuver remote control.

If having proceeded to step S508, the ECU 10 determines that there is a shift-in command in a high boat speed state, sets to 1 a shift-in prohibition flag 2, and executes step S510.

In step S510, the ECU 10 determines whether or not the requested throttle opening degree 1 is lower than a determination value TH2. If the requested throttle opening degree 1 is lower than the determination value TH2, the ECU 10 executes step S511. If on the other hand the requested throttle opening degree 1 is equal to or higher than the determination value TH2, the ECU 10 terminates the series of processes relating to shift-in prohibition determination.

In step S511, the ECU 10 determines whether or not the requested throttle opening degree 2 is lower than the determination value TH2. If the requested throttle opening degree 2 is lower than the determination value TH2, the ECU 10 executes step S515. If on the other hand the requested throttle opening degree 2 is equal to or higher than the determination value TH2, the ECU 10 terminates the series of processes relating to shift-in prohibition determination.

If having proceeded to step S515, all the requested throttle opening degrees 1 and 2 are lower than the determination value TH2, and accordingly the ECU 10 clears the shift-in prohibition flag 1 and executes step S516.

In step S516, the ECU 10 clears the shift-in prohibition flag 2 and terminates the series of processes relating to shift-in prohibition determination.

Figure 6:
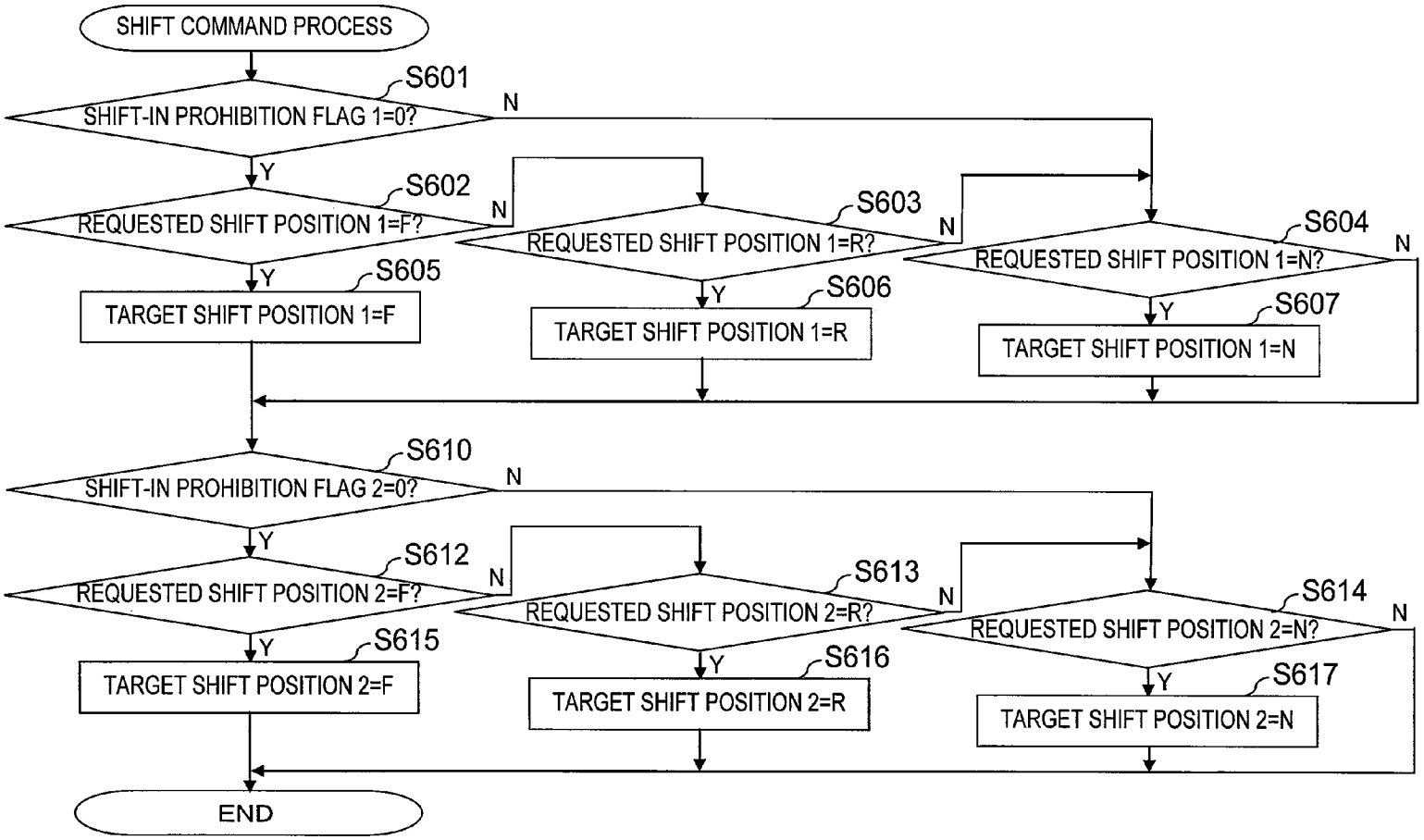
FIG. 6 is a flowchart of a shift command process in Embodiment 1 of the present invention.

FIG. 6 is a flowchart of the shift command process in Embodiment 1 of the present invention. In step S601, the ECU 10 determines whether or not the shift-in prohibition flag 1 is 0. If the shift-in prohibition flag 1 is 0, the ECU 10 executes step S602. If on the other hand the shift-in prohibition flag 1 is set to 1, the ECU 10 executes step S604, in order to perform only an N process.

In step S602, the ECU 10 determines whether or not the requested shift position 1 is set to F. If the requested shift position 1 is F, the ECU 10 executes step S605. If on the other hand the requested shift position 1 is not F, the ECU 10 executes step S603.

In step S603 the ECU 10 determines whether or not the requested shift position 1 is set to R. If the requested shift position 1 is R, the ECU 10 executes step S606. If on the other hand the requested shift position 1 is not R, the ECU 10 executes step S604.

In step S604 the ECU 10 determines whether or not the requested shift position 1 is set to N. If the requested shift position 1 is N, the ECU 10 executes step S607. If on the other hand the requested shift position 1 is not N, the ECU 10 executes step S610.

If having proceeded to step S605, the ECU 10 sets the target shift position 1 to F, instructs the ECU 130 to thereby bring the actual shift to F, and thereafter executes step S610.

If having proceeded to step S606, the ECU 10 sets the target shift position 1 to R, instructs the ECU 130 to thereby bring the actual shift to R, and thereafter executes step S610.

If having proceeded to step S607, the ECU 10 sets the target shift position 1 to N, instructs the ECU 130 to thereby bring the actual shift to N, and thereafter executes step S610.

In step S610, the ECU 10 determines whether or not the shift-in prohibition flag 2 is 0. If the shift-in prohibition flag 2 is 0, the ECU 10 executes step S612. If on the other hand the shift-in prohibition flag 2 is set to 1, the ECU 10 executes step S614, in order to perform only an N process.

In step S612, the ECU 10 determines whether or not the requested shift position 2 is set to F. If the requested shift position 2 is F, the ECU 10 executes step S615. If on the other hand the requested shift position 2 is not F, the ECU 10 executes step S613.

In step S613 the ECU 10 determines whether or not the requested shift position 2 is set to R. If the requested shift position 2 is R, the ECU 10 executes step S616. If on the other hand the requested shift position 2 is not R, the ECU 10 executes step S614.

In step S614 the ECU 10 determines whether or not the requested shift position 2 is set to N. If the requested shift position 2 is N, the ECU 10 executes step S617. If on the other hand the requested shift position 2 is not N, the ECU 10 terminates the series of processes relating to shift command.

If having proceeded to step S615, the ECU 10 sets the target shift position 2 to F and instructs the ECU 230 to thereby bring the actual shift to F, and thereafter terminates the series of processes.

If having proceeded to step S616, the ECU 10 sets the target shift position 2 to R and instructs the ECU 230 to thereby bring the actual shift to R, and thereafter terminates the series of processes.

If having proceeded to step S617, the ECU 10 sets the target shift position 2 to N and instructs the ECU 230 to thereby bring the actual shift to N, and thereafter terminates the series of processes.

Figure 7:
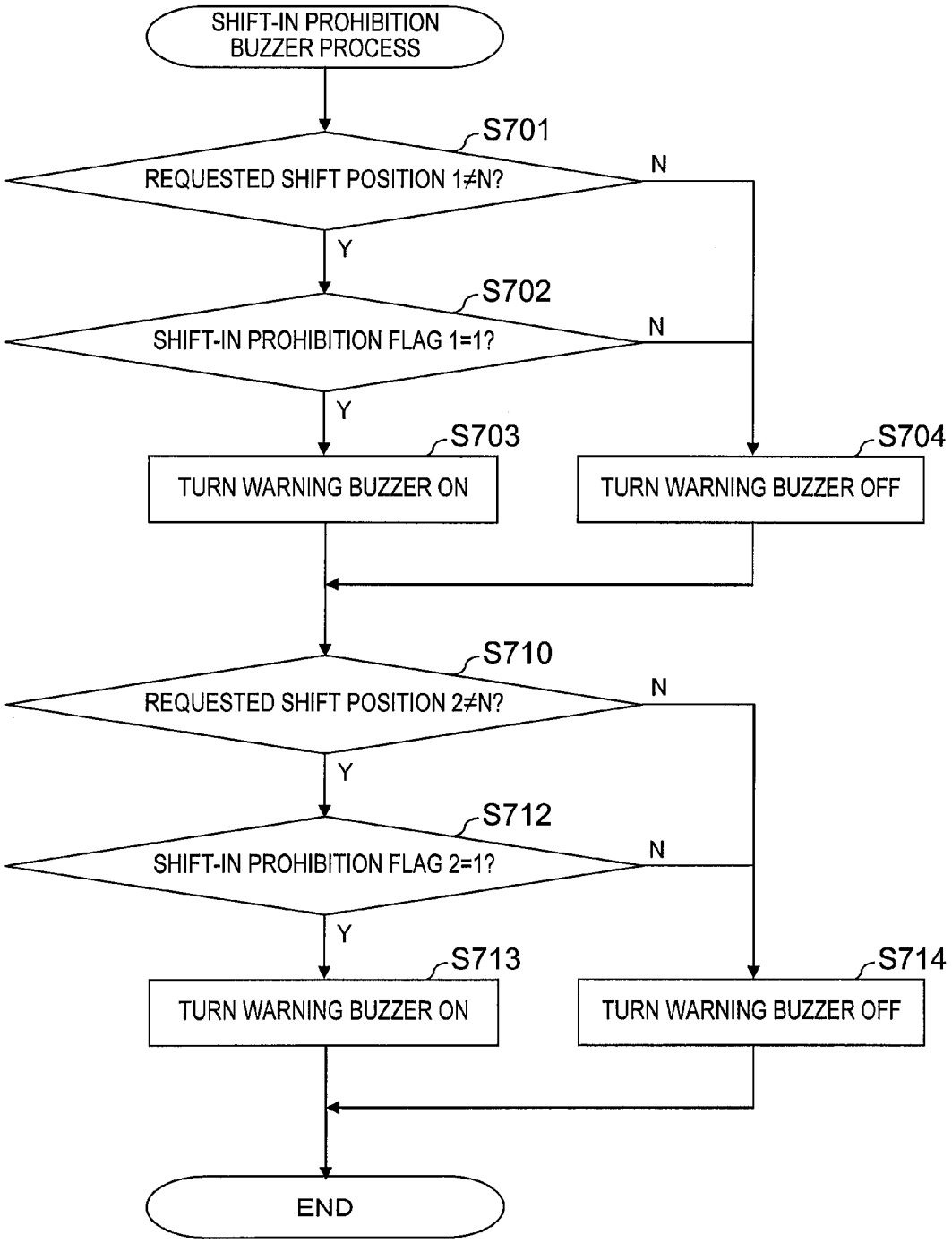
FIG. 7 is a flowchart of a shift-in prohibition buzzer process in Embodiment 1 of the present invention.

FIG. 7 is a flowchart of the shift-in prohibition buzzer process in Embodiment 1 of the present invention. In step S701, the ECU 10 determines whether or not the requested shift position 1 is set to other than N. If the requested shift position 1 is set to other than N, the ECU 10 executes step S702. If on the other hand the requested shift position 1 is N, the ECU 10 executes step S704.

In step S702, the ECU 10 determines whether or not the shift-in prohibition flag 1 is set to 1. If the shift-in prohibition flag 1 is set to 1, the ECU 10 executes step S703. If on the other hand the shift-in prohibition flag 1 is not set to 1, the ECU 10 executes step S704.

If having proceeded to step S703, the ECU 10 turns on the warning buzzer 15, in order to inform the boat operator that the operation is abnormal, and executes step S710.

If having proceeded to step S704, on the other hand, the ECU 10 determines that the operation is not abnormal, turns off the warning buzzer 15, and executes step S710.

In step S710, the ECU 10 determines whether or not the requested shift position 2 is set to other than N. If the requested shift position 2 is set to other than N, the ECU 10 executes step S712. If on the other hand the requested shift position 2 is N, the ECU 10 executes step S714.

In step S712, the ECU 10 determines whether or not the shift-in prohibition flag 2 is set to 1. If the shift-in prohibition flag 2 is set to 1, the ECU 10 executes step S713. If on the other hand the shift-in prohibition flag 2 is not set to 1, the ECU 10 executes step S714.

If having proceeded to step S713, the ECU 10 turns on the warning buzzer 15, in order to inform the boat operator that the operation is abnormal, and thereafter terminates the series of processes of the shift-in prohibition buzzer.

If having proceeded to step S714, on the other hand, the ECU 10 determines that the operation is not abnormal, turns off the warning buzzer 15, and thereafter terminates the series of processes of the shift-in prohibition buzzer.

The boat shift control device of Embodiment 1 explained above has a configuration for controlling in particular engines by way of a remote control ECU (corresponding to the ECU 10) at a maneuvering seat, in a drive-by-wire (DBW) system where a plurality of engines is installed in one boat and in which no wires are utilized.

The functions of the ECU 10 are summarized next.

(1) Simulated boat speed detection process function Function of calculating a simulated boat speed revolutions obtained by simulating boat speed on the basis of the rotational speeds of a plurality of engines.

(2) Turning mode detection process function

Function of detecting a "turning mode" denoting the state in which there is performed an operation of changing the orientation of the hull using a given specific engine alone, during docking, on the basis of the shift state and throttle state of a plurality of engines and on the basis of a calculated simulated boat speed, and of setting/resetting a turning mode flag.

(3) Shift-in prohibition determination process function

Function of setting/resetting a shift-in prohibition flag that prohibits shift-in of a respective engine, on the basis of the shift state and throttle state of the plurality of engines, the calculated simulated boat speed, and the state of the turning mode flag.

The process of setting the shift-in prohibition flag is not executed during the turning mode. The shift-in prohibition flag is reset as a result of a condition being satisfied where all the requested throttle opening degrees of the plurality of engines are lower than a pre-set opening degree determination value. The shift-in prohibition flag is reset also in a case where there is satisfied the condition where all the shift states of the plurality of engines are the neutral state.

(4) Shift command process function

Function of outputting a shift command to respective engines on the basis of the shift state of the plurality of engines and the state of the shift-in prohibition flag.

(5) Shift-in prohibition buzzer process function

Function of, in a state where the shift-in prohibition flag has been set, notifying by way of a warning sound that a shift-in prohibited state applies when the boat operator performs a shift-in operation to F or R.

The above functions allow eliciting the following effects during actual boat maneuvering.

In a case where a plurality of engines is mounted on one boat, the highest speed from among the engine rotational speeds is selected as a simulated boat speed, and is stored in a buffer. Simulated boat speed revolutions are calculated by performing a conjectured computation process using the selected rotational speed.

Next, shift-in is prohibited in a case where the lever is operated to forward (F) or reverse (R) in an attempt to operate the remaining engines, when the calculated simulated boat speed revolutions exceed a pre-set determination value, for instance during operation with only one engine from among the plurality thereof. As a result it becomes possible to protect the gears and engines during the shift operation in a state where propellers have turned due to accompanying rotation, without operating the remaining engines.

Further, shift-in is prohibited when the simulated boat speed revolutions exceed a determination value; once prohibited, shift-in stays so until the throttle states of all the connected engines become equal lower to or smaller than a pre-set determining degree of opening.

With shift-in prohibited, a state is brought about in which the gear cannot actually be put in when the lever is moved to forward (F) or reverse (R). Therefore, the maneuver intention of the boat operator is determined on the basis of a switch operation state of the lever, and an alert through a buzzer or LED can be outputted in a case where it is determined that the boat operator intends to maneuver the boat in a shift-in prohibited state. As a result, the boat operator can easily grasp, thanks to the warning output, that a shift-in prohibited state holds.

The purpose of the shift-in prohibited state in the present invention is to protect gears and engines during shift-in when in a state of boat speed equal to or higher than a boat speed established beforehand. During docking and turning, an operation is performed whereby the bearing of the hull is modified using a predetermined engine alone. During such docking and turning, the boat operator may conceivably operate only a specific engine at high revolutions. In some instances turning is accomplished by setting respective engines to forward (F) or reverse (R).

In such cases a shift-in prohibited state may be conceivably brought about during docking or turning, depending on pre-set data in order to determine the shift-in prohibition. Maneuverability during docking or turning is envisaged to become very poor as a result.

In the present invention, therefore, a turning mode is determined to apply in a case where it is detected that the shift states of the plurality of engines are a state such that turning involves mixed forward (F) and reverse (R), or when a state goes on, for a predetermined lapse of time, where the shift states of the plurality of engines are all forward (F) and the throttle states all lie within a determination value established beforehand.

As a characterizing feature, the state of shift-in prohibition is made absolutely invalid in a case where it is determined that the turning mode applies. In consequence it becomes possible to combine securing maneuverability during docking or turning with shift-in prohibition for the purpose of protecting gears and engines within a certain boat speed range, and also to secure maneuverability in the shift operation at low speed.

What is claimed is:

1. A boat shift control device that controls shift-in and shift-out of a plurality of engines mounted on a boat, comprising:

a rotational speed detector that detects a rotational speed of each of the plurality of engines;

a lever position (LP) sensor that detects any one shift state from among forward, reverse and neutral, on the basis of an operation state of respective throttle levers corresponding to the plurality of engines; and a controller that controls the plurality of engines, wherein the controller detects a simulated boat speed on the basis of the respective rotational speeds of the plurality of engines; and in a case where the simulated boat speed is higher than a pre-set first determination value when from a state in which the boat is operated by a part of the plurality of engines an attempt is made to operate the remaining engine being in a neutral shift state, the controller sets a shift-in prohibition flag of a corresponding engine, and prohibits shift-in control of the remaining engine.

2. The boat shift control device of claim 1, wherein the controller detects, as a requested throttle opening degree, a request amount of respective throttle valves of the plurality of engines, on the basis of the respective shift states of the plurality of engines as detected by the LP sensor; and in a case where there is satisfied a first condition where all the shift states of the plurality of engines are a neutral state, or there is satisfied a second condition where all requested throttle opening degrees of the plurality of engines are lower than a pre-set opening degree determination value, the controller resets the shift-in prohibition flag and, so long as the first condition or the second condition is not satisfied, maintains a state in which the shift-in prohibition flag is set, to prohibit shift-in control of the remaining engine.

3. The boat shift control device of claim 1, wherein in a case where on the basis of a detection result by the LP sensor there is detected a shift-in operation in an engine for which the shift-in prohibition flag has been set, the controller outputs a warning to a boat operator to the effect that shift control is in a prohibited state.

4. The boat shift control device of claim 2, wherein in a case where on the basis of a detection result by the LP sensor there is detected a shift-in operation in an engine for which the shift-in prohibition flag has been set, the controller outputs a warning to a boat operator to the effect that shift control is in a prohibited state.

5. The boat shift control device of claim 1, wherein the controller determines that a turning mode applies in a case where the simulated boat speed is lower than a pre-set second determination value and in the plurality of engines there are mixed a forward-state engine and a reverse-state engine, on the basis of the shift states detected by the LP sensor, and enables the shift-in control of all engines, regardless of the setting state of the shift-in prohibition flag, during the turning mode.

6. The boat shift control device of claim 2, wherein the controller determines that a turning mode applies in a case where the simulated boat speed is lower than a pre-set second determination value and in the plurality of engines there are mixed a forward-state engine and a reverse-state engine, on the basis of the shift states detected by the LP sensor, and enables the shift-in control of all engines, regardless of the setting state of the shift-in prohibition flag, during the turning mode.

7. The boat shift control device of claim 3, wherein the controller determines that a turning mode applies in a case where the simulated boat speed is lower than a pre-set second determination value and in the plurality of engines there are mixed a forward-state engine and a reverse-state engine, on the basis of the shift states detected by the LP sensor, and enables the shift-in control of all engines, regardless of the setting state of the shift-in prohibition flag, during the turning mode.

8. The boat shift control device of claim 4, wherein the controller determines that a turning mode applies in a case where the simulated boat speed is lower than a pre-set second determination value and in the plurality of engines there are mixed a forward-state engine and a reverse-state engine, on the basis of the shift states detected by the LP sensor, and enables the shift-in control of all engines, regardless of the setting state of the shift-in prohibition flag, during the turning mode.

9. A boat shift control method that is executed by a controller that controls shift-in and shift-out of a plurality of engines mounted on a boat, the method comprising:

a first step of calculating a simulated boat speed of the boat on the basis of respective rotational speeds of the plurality of engines as detected by a rotational speed detector;

a second step of detecting, on the basis of a detection result by an a lever position (LP) sensor that detects any one shift state from among forward, reverse and neutral on the basis of an operation state of respective throttle levers corresponding to the plurality of engines, a shift-in operation state where, from a state in which the boat is operated by a part of the plurality of engines, an attempt is made to operate the remaining engine being in a neutral shift state; and a third step of setting a shift-in prohibition flag of a corresponding engine, and prohibiting shift-in control of the remaining engine if, upon detection of the shift-in operation state according to the second step, the simulated boat speed calculated in the first step is higher than a pre-set first determination value.

* * * * *